United States Patent [19]

Sakai et al.

[11] Patent Number: 4,477,316

[45] Date of Patent: Oct. 16, 1984

[54] LONG-LIFE INSOLUBLE ELECTRODE AND PROCESS FOR PREPARING THE SAME

[75] Inventors: Kango Sakai; Ryoichi Yoshihara, both of Kitakyushu; Hiroshi Sakurai; Katsuhiro Minamida, both of Kawasaki, all of Japan

[73] Assignee: Nippon Steel Corporation, Tokyo, Japan

[21] Appl. No.: 351,302

[22] Filed: Feb. 22, 1982

[30] Foreign Application Priority Data

Feb. 23, 1981 [JP] Japan ..... 56-25090

[51] Int. Cl.[3] ..... B05D 1/08; B05D 3/06; C25B 11/60; C25C 7/02

[52] U.S. Cl. ..... 204/290 F; 204/290 R; 427/53.1; 427/126.5; 427/295

[58] Field of Search ..... 427/53.1, 126.5, 295; 204/290 F, 290 R

[56] References Cited

U.S. PATENT DOCUMENTS

| | | | |
|---|---|---|---|
| Re. 28,820 | 5/1976 | Beer | 204/290 X |
| 3,775,157 | 11/1973 | Fromson | 427/53.1 X |
| 4,214,918 | 7/1980 | Gat et al. | 427/53.1 X |
| 4,349,581 | 9/1982 | Asano et al. | 427/53.1 X |

FOREIGN PATENT DOCUMENTS

| | | |
|---|---|---|
| 52-20988 | 2/1977 | Japan . |
| 53-87938 | 8/1978 | Japan . |
| 56-47597 | 4/1981 | Japan . |
| 56-119787 | 9/1981 | Japan . |

*Primary Examiner*—Michael R. Lusignan
*Attorney, Agent, or Firm*—Cushman, Darby & Cushman

[57] ABSTRACT

The present invention relates to preparation of insoluble electrodes having few surface defects and long life. The process for the preparation of electrodes comprises coating the surface of an electroconductive, corrosion resisting base metal (1) with at least one member selected from the platinum group metals and applying laser beams having energy density of 1 KW/cm$^2$ or higher to the coated surface at a laser energy of 10 Kjoule/cm$^2$ or less, thereby improving said surface due to its rapid heat treatment.

20 Claims, 12 Drawing Figures

LONG-LIFE INSOLUBLE ELECTRODE AND PROCESS FOR PREPARING THE SAME

BACKGROUND OF THE INVENTION

The present invention relates to an insoluble electrode used for electrolytic treatment of an aqueous solution and a process for the preparation of such electrode. More particularly, the present invention relates to a process for the preparation of insoluble electrodes having few surface defects, which comprises coating the surface of an electroconductive, corrosion resisting base metal, such as titanium, niobium, zirconium, tantalum, an alloy thereof, or other electroconductive, corrosion resisting base metal, with at least one layer of the platinum group metals and irradiating the coated surface with laser beams in an oxidizing or non-oxidizing atmosphere. Furthermore, the present invention relates to long-life insoluble electrodes prepared by such a process.

Insoluble electrodes are frequently used as electrodes in the electrolytic industry. As the typical processes for the preparation of these insoluble electrodes, there have been adopted (1) a process comprising plating a metal of the platinum group on an electroconductive, corrosion resisting base metal, such as titanium, and (2) a process comprising plating a metal of the platinum group on such an electroconductive base metal and then subjecting the plated base metal to a heat treatment.

Electrodes prepared according to these conventional processes, however, are inevitably defective in various points and are not practically suitable for industrial-scale applications.

The conventional electroplating process will now be described with reference to FIG. 1.

FIGS. 1A through 1D are diagrams illustrating the relation of the deposition state to the deposition amount and plating thickness, which is observed when platinum is plated on an electroconductive base metal consisting of titanium. When the deposition amount of platinum is small such as 0.2 μm, as shown in FIG. 1A, the absolute amount of plated platinum is small and the platinum is deposited only locally, so that the surface of the resulting electrode contains many defects. Even if the deposition amount of platinum is increased to 1 or 3 μm, the platinum tends not to become deposited on new areas of the electroconductive base metal consisting of titanium but rather preferentially grows on the already deposited platinum; thus, the platinum does not completely cover the titanium surface. It is only when the deposition amount of platinum becomes large, such as about 7 μm, that the titanium surface is substantially covered. However, such an increase of the plating thickness increases the plating cost. Also, such a large amount of platinum often causes coarse crystals to be formed. In such a case, the resulting electrode is defective in that a coating with many pinholes is liable to form and the adherence of the plating layer to the electroconductive base metal is poor. There is a preparation process, in which striking plating may be carried out beforehand, but the complete prevention of defects cannot be attained.

If defects, such as pinholes, are present on the surface of an electrode plated with the platinum group metals, the current concentrates around the pinholes, especially when electrolysis is carried out at a high current density, and cracks form around the pinholes, resulting in peeling of the plating layer and extreme shortening of the life of the electrode.

More important, as disclosed in Japanese patent application Laid-Open No. 53-87938 filed by the assignee here of, and laid open Aug. 2, 1978, during electrolytic treatment, the stoppage of application of the electric current cannot be avoided, and when the electric current is not applied, the potentials of the anode and the cathode are reversed; that is, the anode becomes cathodic and the cathode becomes anodic. Accordingly, since reversion of the potentials is repeated when the application of the electric current is stopped and resumed, the life of the electrode is shortened, and if there are pinholes present when the electrode is used under the above conditions, corrosion of the electroconductive base metal by the repeated reversion of the potentials starts from the location of the pinholes, with the result that peeling of the platinum plating layer takes place and the life of the electrode is further shortened.

As a means for eliminating the surface defects caused by electroplating, there has been adopted a method in which the heat treatment is carried out in a heating furnace or flame. It is said that pinholes are removed and the plating layer is alloyed with the electroconductive base metal to improve the adhesion and corrosion resistance. However, even if this heat treatment is conducted, it is difficult to obtain an electrode having the desired characteristics.

More specifically, a temperature higher than 600° C. is necessary so as to induce diffusion between the electroconductive base metal and the platinum group metals plated on the electroconductive base metal. Due to a conventional heat treatment at a temperature higher than 600° C., the electroconductive base metal is deformed, and the diffusion between the electroconductive base metal and the platinum group metals plated on the electroconductive base metal becomes difficult to control, grain coarsening of the electroconductive base metal and platinum group metals takes place, and cracks are formed. Furthermore, since the conventional heat treatment at a high temperature must be carried out over a long period of time, the mechanical strength and electric conductivity of the electroconductive base metal become deteriorated, due to oxidation in the case of the heat treatment in an oxidizing atmosphere and due to the formation of nitrides in the case of the heat treatment in a nitrogen atmosphere. Therefore, the heat treatment has usually been carried out in a vacuum.

Referring to FIG. 2, there is illustrated an example of the microscopic structure of a cross section of a platinum-plated titanium electrode which has been heat treated in a vacuum by a conventional process. More specifically, the heat treatment was carried out at 1000° C. over a period of 15 minutes in a vacuum. A thick and coarse alloy layer comprised of $Pt_3Ti$ and $PtTi_3$ was grown by the heat treatment, as seen in FIG. 2. The electrode, having the microscopic structure as shown in FIG. 2, has a short life because of the reasons which will be explained in detail later. Selection of appropriate conditions for the formation of an alloy layer and appropriate conditions for preventing oxidation or nitriding of the electroconductive base metal are very difficult and it also is difficult to control the diffusion of the plated metal in the conventional heat treatment as explained hereinabove.

It was previously proposed, in assignee's Japanese Laid Open patent application No. 56-47597 laid open Apr. 30, 1981, a process for the preparation of the platinum-plated titanium electrodes in which the foregoing disadvantages are eliminated. According to this process, in order to prevent the formation of pinholes during electroplating of the platinum group metals and to remove the undesired influences of the heat treatment conducted at a high temperature, a solution of a compound of the platinum group metals is coated on a plating layer of the platinum group metals after electroplating and the coated base metal is heated at a relatively low temperature in a non-oxidizing atmosphere to effect thermal decomposition and thermal diffusion.

The defects and disadvantages involved in the conventional techniques can considerably be eliminated, according to this process, but since a Cl, NO or $NO_2$ compound is used as the platinum group metal compound to be coated and since decomposition is carried out at a relatively low temperature, the decomposition is insufficient and there is a risk that impurities, such as Cl, NO and $NO_2$, will be left in the plating layer, thereby reducing corrosion resistance. Furthermore, since the heat treatment is conducted at a low temperature, the adhesion of the plating layer is not sufficient.

Japanese Laid Open patent application No. 52-20988 laid open Feb. 17, 1977 (corresponds British Provisional Specification No. 47235/1974); and No. 56-119787 laid open Sept. 19, 1981 (corresponds U.K. patent application GB No. 2067537A) describe the processes of making insoluble electrodes by means of laser beam irradiation. In the former Japanese Laid Open patent application, it is disclosed that laser beams are directly applied onto the surface of an electroconductive base metal, so as to improve its qualities, while in the latter Japanese Laid Open patent application the surface of an electroconductive base metal is directly coated with a metal oxide and then laser beams are applied onto the coated surface. In the process in which the laser beams are directly applied onto the electroconductive base metal, the quality improvement due to the laser beam irradiation is appreciable, but a good corrosion resistance cannot be achieved, because the inherent corrosion resistance of the base metal is not sufficient for that required for insoluble electrodes. On the other hand, in the process in which the direct coating of a metal oxide on an electroconductive base metal is followed by laser beam irradiation, it is difficult to form a continuous layer by means of applying the metal oxide. In addition, as described in detail hereinbelow, a diffusion layer of metal oxide and the electroconductive base metal is hardly formed so that the coating formed is not sufficient for the protection of such base metal. This is one of the problems involved in the process mentioned above.

DETAILED DESCRIPTION OF THE INVENTION

It is an object of the present invention to substantially solve the problems involved in the conventional techniques, and it is a primary object of the present invention to provide an insoluble electrode having no plating defects on the surface and having a long life. Another object of the present invention is to provide an insoluble electrode which is dimensionally stable.

These drawbacks can be overcome by a process according to the present invention for the preparation of a long-life insoluble electrode, which comprises the steps of coating the surface of an electroconductive, corrosion resisting base metal with at least one metal layer of at least one member selected from the platinum group metals, and subsequently irradiating the coated surface by laser beams. The irradiation forms between the electroconductive corrosion-resistant base metal and the metal layer–a diffusion layer over portions of the base metal not covered by the metal layer in the coating step. The laser-formed diffusion layer is not greater than about 1 μm in thickness. The platinum group metals suitable herein include platinum, iridrum, ruthenium, rhodium and palladium. Occasionally, an oxide or oxides of the platinum group metals may be coated, as an overlying layer, on at least one metal layer and then the laser beam irradiation may be carried out.

According to conventional techniques, the heat treatment is carried out in an electric furnace or in a flame after the electroconductive base metal has been plated with a metal of the platinum group or a compound thereof. Alternatively, laser beams are applied directly onto the electroconductive base metal or through the coating of metal oxide onto the base metal. The present invention is distinguished from over these conventional techniques in that the heat treatment, after the plating step of at least one metal layer consisting of platinum group metals, is carried out by irradiation with laser beams. The process of the present invention is quite different from the conventional heating process, and an insoluble electrode, prepared according to the process of the present invention, has an excellent performance because the platinum group metals can be diffused onto the surface region of the electroconductive base metal and can form an extremely thin alloy layer.

Heat treatments utilizing laser beams are performed in various fields at the present, and the mechanism of such a heat treatment has been considerably clarified. The heat treatment utilizing laser beams, according to the present invention, is characterized in that the wave length absorbing property on the surface of a material to be irradiated is utilized and the efficiency of the heat treatment is increased by the wave length of the laser beams.

For example, a $CO_2$ laser has a wave length of 10.6 μm and a YAG laser has a wave length of 1.06 μm. These lasers are utilizable ones on an industrial scale at the present, and the treatment depth can easily be controlled by changing the quantity of energy.

Accordingly, by appropriately selecting these conditions, the absorptance on the surface of the material to be irradiated can be increased. Furthermore, if the energy density of laser beams is increased, high-speed high-temperature heating can be performed, and if the heat treatment is conducted only in the vicinity of the surface layer, rapid cooling becomes possible.

According to the present invention, by appropriately selecting a coating structure of insoluble electrodes and applying these characteristics of laser beams to the preparation of insoluble electrodes, insoluble electrodes having an excellent performance, as described hereinafter, can be obtained.

The process for preparing electrodes by irradiating laser beams and the coating structure according to the present invention will now be described.

DETAILED DESCRIPTION OF THE DRAWINGS

Figure 1A:
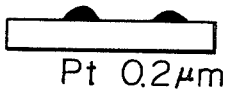
FIGS. 1A, 1B, 1C and 1D are diagrams illustrating the deposition state of platinum, which is observed when platinum is plated on an electroconductive base material consisting of titanium according to the conventional process.
Figure 1B:
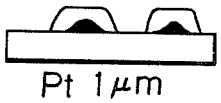
Figure 1C:
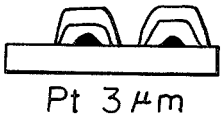
Figure 1D:
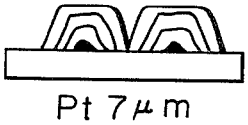
Figure 3A:
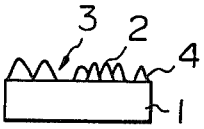
FIG. 3A is a diagram illustrating the state where platinum is plated at a thickness of 1 μm on an electroconductive base metal of titanium and FIG. 3B is diagram illustrating the state where the surface of the platinum-plated base metal, shown in FIG. 3A, is irradiated with laser beams.

FIG. 3A is a diagram illustrating the state where platinum is plated in a thickness of 1 μm on an electroconductive base metal consisting of titanium. Platinum 2, electroplated on a titanium electroconductive base metal 1, is insufficient to cover the surface of the electroconductive base metal, and pinholes 3 and grain boundaries 4 are present, so that the life of such an electrode becomes too short to be considered useful. However, if the laser beams irradiation is applied to the platinum-plated surface, a part or all of the electroplated platinum becomes molten by the high temperature and an improved state, as shown in FIG. 3B, is produced.

Figure 3B:
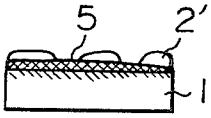

In FIG. 3B, platinum 2' on the surface layer becomes molten and smoothened, so that the grain boundaries are closed, and a continuous film 5 is formed. Furthermore, pinholes disappeared by the melting and diffusion of the platinum and an extremely thin diffusion layer, indicated by oblique lines, was formed. Of course, these effects change, according to the conditions of the laser beam irradiation and formation of the coating.

Namely, under certain irradiation conditions, melting of the surface layer and closing of the pinholes or closing of the grain boundaries are accomplished, but no substantial diffusion layer is detected by means of an X-ray diffractometry or by observation of the cross section of the coating with the aid of an X-ray microanalyzer.

Figure 4A:
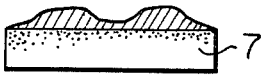
FIG. 4A is a diagram illustrating the state where a platinum-plated electroconductive base metal consisting of titanium is heat-treated according to the conventional method.
Figure 4B:
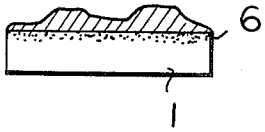
FIG. 4B is a diagram illustrating the state where a platinum-plated electroconductive base metal consisting of titanium is irradiated with laser beams.
Figure 2:
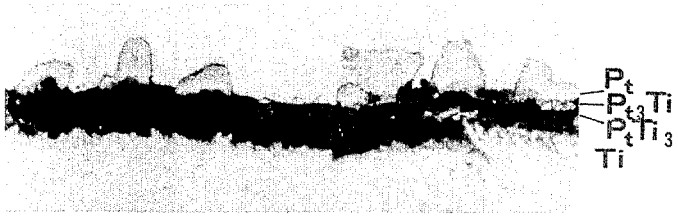
FIG. 2 shows a microscope structure of a conventional platinum-plated titanium electrode.
Figure 5:
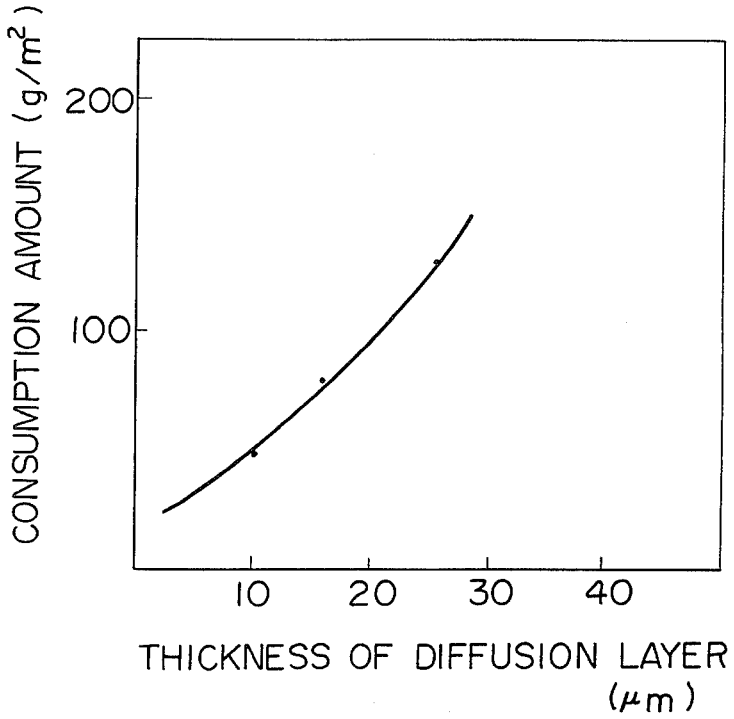
FIG. 5 is a graph indicating the relationship between the thickness of the diffusion layer and the consumption rate of insoluble electrodes which were prepared by an electroplating of platinum up to a thickness of 3 μm and heated to various temperatures in a vacuum for 15 minutes.

At the time of the irradiation with the laser beams, only a thin portion of the surface layer of the titanium electroconductive base metal can be heated, as shown in FIG. 4B, by appropriately selecting the laser beam irradiation condition, and platinum on the surface is diffused only in this heated portion. Accordingly, the alloy layer 6 formed is enriched with platinum and is extremely thin. In contrast, according to the conventional heat treatment process in a heating furnace or by a flame, the titanium electroconductive base metal is entirely heated at a high temperature for a long time, as shown in FIG. 4A, and a diffusion layer 7 is thickly distributed. The thickness of the diffusion layer between the electroconductive base metal and the platinum exerts a great influence on the life of insoluble electrodes. The life of the electrodes is short when a thick diffusion layer is formed by means of heat treatment in a vacuum, as illustrated in FIG. 5 which indicates the relationship between the thickness of a diffusion layer of electrodes having a 3 micron thick Pt plating layer and the consumption amount of these electrodes in $g/m^2$ during electrolysis. The thickness of the diffusion layer was measured by polishing the cross section of the electrodes at a slanted angle of 5 degrees and then by studying the layer by microscopic observation. The electrolysis was carried out under the conditions of Example 1 described later.

In the preparation process of insoluble electrodes utilizing laser beam irradiation, it is easy to provide insoluble electrodes having a very thin diffusion layer. For example, when the $C0_2$ laser, which has a high output at the present time, is used for irradiation at an energy density of 10 kjoule/$cm^2$, the diffusion layer formed after an irradiation period of 3 seconds amounts to only 1 μm at the maximum.

As is apparent from the foregoing description, the most characteristic feature of the present invention is that a plating metal-rich, very thin diffusion alloy layer is formed in a very limited vicinity of the surface layer of the electroconductive base metal, and by virtue of this characteristic feature, an electrode, having an excellent characteristic, as described hereinafter, can be prepared according to the present invention.

The durability of electrodes is enhanced by laser beam irradiation due to the facts that: (1) defects of the platinum plating layer are removed thereby improving the surface quality of the platinum plating layer: and, (2) the diffusion layer is formed between the platinum layer and the electroconductive base metal, as described hereinabove. In addition to this, it is possible to mention as reasons for the durability enhancement the facts that: (3) the absorbed hydrogen in the plating layer is removed; and, (4) the surface region of the electroconductive base metal is improved. The laser beam irradiation condition determines which one or more of the four effects (1) through (4) are attained, and by attaining any one of the four effects, the life of the electrode is prolonged. Obviously, the most preferable condition of laser beam irradiation is for all four effects to be attained. The formation of the diffusion layer mentioned in item (2), above, can be confirmed by an X-ray diffraction method, an analysis method using an X-ray microanalyzer or a microscopic observation of the cross section of an electrode in which a specimen is embedded at a slant position and then polished.

Since the thickness of the diffusion layer, according to the present invention, is not more than 1 μm and thus very thin, it is difficult to obtain a strict relationship between the thickness of the diffusion layer and the condition of the laser beam irradiation. However, when the laser beam irradiation is carried out under the conditions explained hereinafter, desirable heat treament can be achieved. It is found that if the energy density is lower than 1 $KW/cm^2$ the four effects mentioned above, including diffusion, hardly occur and refining of the plated metal crystals does not occur.

If the energy density is 1 $KW/cm^2$ or higher heat concentration on the surface of the workpiece and diffusion of the plated metal are observed, and if the energy density is higher than 10 $KW/cm^2$, the plated metal is diffused to such an extent that the corrosion resistance and adhesion of the plating layer are prominently improved and the plated metal crystals are finely divided. Furthermore, if the energy density is higher than 10 KW/cm$^2$ and the irradiation time is longer than 30 milliseconds, removal of hydrogen from the electroconductive base metal is observed.

The irradiation time is desirably short, while a high output laser, having an energy density of at least 1 KW/cm$^2$, as mentioned above, is desirable in order to carry out the heat treatment according to the present invention. The laser energy of the laser beams applied to the workpiece during the irradiation time should be 10 kjoule/cm$^2$ or higher. Laser energy exceeding 10 kjoule/cm$^2$ is so high that electroconductive base metal may be deformed, and plated platinum may scatter and may be deteriorated. The energy density or irradiation time for obtaining the above mentioned input power should, however, be adjusted, depending upon the kind of plated metal. For example, in a case where irradiation occurs for longer than 3 seconds, the heat treated zone extends into the electroconductive base metal consisting of titanium, so that it is impossible to control the diffusion layer in a desirable manner. In order to realize a short irradiation time period, either the laser source or the workpiece (electrode) is displaced relative to the other, or, alternatively, a pulse laser is employed for laser beam irradiation.

The conditions of laser beam irradiation will now be theoretically described.

When the laser beam is applied on a workpiece in the form of spots, the power input Q (kjoule/cm$^2$) is expressed by:

$$Q=D\cdot t \quad (1),$$

wherein "D" denotes the energy density (KW/cm$^2$) and "t" denotes the irradiation time (seconds).

When either the laser source or the workpiece (electrode) is displaced relative to the other, the power input is expressed by:

$$Q=D\cdot R\cdot 1/V \quad (2)$$

wherein "R" denotes the diameter of a laser spot (cm) and "V" denotes the irradiation speed (cm/second).

Figure 6:
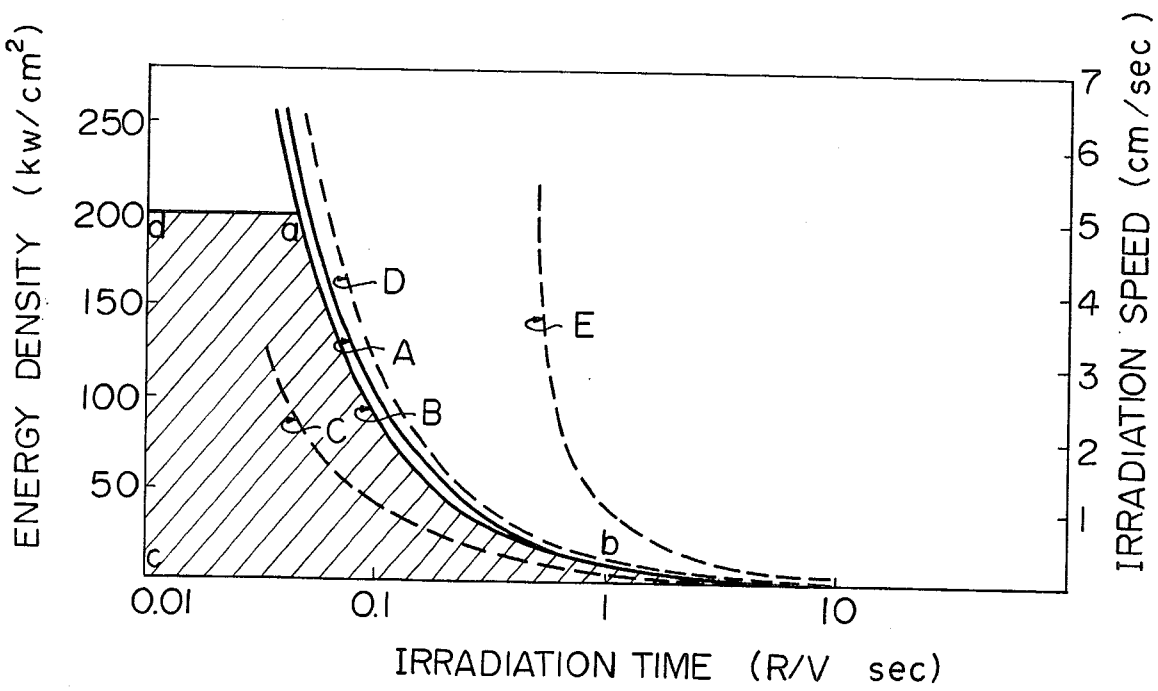
FIG. 6 is a graph illustrating conditions of laser beam irradiation.

The equation (2) is graphically illustrated in FIG. 6 with the letters indicated on the curve denoting the following values.

A—laser evergy (Q) is 10 kjoule/cm$^2$.
B—laser energy (Q) is 9 kjoule/cm$^2$.
C—diameter of laser spot (R) is 1 mm.
D—diameter of laser spot (R) is 3 mm
E—diameter of laser spot (R) is 10 mm.

The conditions of laser beam irradiation, according to the present invention, are such that the energy density (D) and the irradiation time (R/V) in seconds are located on the left side of the curve A, and, preferably, on the left side of the curve B. When the diameter of the laser spot is 3 mm (curve D) or 10 mm (curve E), the energy density according to the present invention cannot be fulfilled. If the irradiation speed (V) is on the left side of the curve A for example as shown by the curve C, the irradiation speed (V) and irradiation time (R/V) can be appropriately selected by means of the curve C.

A preferable condition of the laser beam irradiation for a platinum-plated titanium electrode is indicated by the area defined by the connecting points "a", "b", "c", and "d", as well as by the curve B. A more preferable condition of the laser beam irradiation for a platinum-plated titanium electrode lies within the area mentioned above and is such that the laser energy is in the range of from 0.1 to 10 kjoule/cm$^2$.

In the laser beam irradiation, the surface of the platinum plating layer is momentarily exposed to a high temperature. Occasionally, it is, therefore, necessary to control the atmosphere of laser beam irradiation by means of, for example, blowing argon gas, nitrogen and the like onto the surface of the workpiece being subjected to laser beam irradiation. Usually, the oxidizing atmosphere of ambient air is sufficient for the atmosphere of laser beam irradiation, because the platinum group metals are difficult to oxidize and, further, only the surface of the platinum plating layer is heat treated.

Incidentally, in the prior art process of laser beam irradiation, in which the metal oxide is directly applied on an electroconductive base metal and is then subjected to laser beam irradiation, formation of the continuous film 5, as shown in FIG. 3B, or the closing of grain boundaries and the pinholes is difficult to achieve because of the metal oxide directly applied on the electroconductive base metal. A more significant or serious result of directly applying the laser beam to the metal oxide on the electroconductive base metal resides in the fact that metal oxide does not diffuse into the surface region of the electroconductive base metal and, thus, no alloy layer is formed. Therefore, the laser beam irradiation according to the prior art process is inferior to, that of the present invention, in which the metal, i.e. one of the platinum group metals, is directly applied on an electroconductive base metal, when considering whether such irradiation is effective for enhancing the corrosion resistance of the electroconductive base metal and for satisfactorily prolonging the life of the electrode.

A coating layer mainly composed of the platinum group metals, which is formed on the surface of an electroconductive base metal of an electrode in the present invention, will now be described.

As described hereinbefore, according to the present invention, a coating, consisting of at least one layer of the platinum group metals, is first formed on an electroconductive base metal of an electrode and the heat treatment is then carried out by irradiation with laser beams, and the special effect by this heat treatment is utilized in the present invention. When the coating structure includes as the first layer a metal layer(s) of one or more platinum group metals, the coating structure can be varied irrespective of the formation of the other layers, the kind of material of the other layers and the kind of methods for forming the coating.

The present invention includes various embodiments, differing in the kind of the coating and the order of the treatments. Typical instances are as follows.

(A) An operation, in which one of the platinum group metals is electroplated on, for example, titanium and then the plated surface is irradiated with laser beams, is conducted one or two times.

(B) An operation, in which at least two platinum group metals, for example titanium and then one of the platinum group metals, are electroplated and then the plated surface is irradiated with laser beams, is conducted once or repeated at least two times.

(C) One or more of platinum group metals are electroplated, the plated surface is irradiated with laser beams, one or more of the platinum group metals, different from the already plated platinum group metals are coated on the previous plating layer and are then irradiated with laser beams.

(D) In the above-mentioned methods (A) through (C), a thermal decomposition plating is carried out by applying a solution of a platinum group metal compound instead of using electrolytoplating. A coating is formed according to another method. Finally, irradiation with laser beams is carried out.

(E) One or more of the platinum group metals are electroplated, the plated surface is irradiated with laser beams, one of the platinum group metals is applied according to a method other than electroplating, such as the ion plating method and the thermal decomposition plating method for thermally decomposing of solution applied on workpiece and the coated surface is irradiated with laser beams, or the order of the electroplating and the coating procedures is reversed, and, finally, irradiation with laser beam is carried out.

(F) In method (E), instead of the thermal decomposition plating of a platinum group metal, a coating of an oxide of a platinum group metal, is formed, and then, irradiation with laser beams is carried out.

(G) In order to form the oxide coating of the method (F), an oxide of a platinum group metal is coated by, for example, a vacuum plating method, and irradiation with laser beams is then carried out.

When the plating of the platinum group metals is carried out to provide a thick plating layer, such plating usually prolongs the life of the electrode. However, according to the present invention, a thin plating layer without pinholes can be provided and a long electrode life can be advantageously ensured by a plating thickness in the range of from 1 to 6 μm. Conventional electrodes provided with the plating layer having a thickness in such range include many pinholes, while in the present invention the laser beam irradiation can remove the plating defects, whereby the thinly plated electrodes give a satisfactory performance. However, if the plating thickness is 0.9 μm or less, a continuous coating may occasionally not be obtained and the life of the electrode is short when subjected to high current density electrolysis. The plating thickness of at least 1 μm is therefore necessary. On the other hand, if the plating thickness exceeds 6 μm, the cost of the electrodes is increased, so that they are not acceptable as commercially available consumable materials.

The following effects can be attained by the above-mentioned processes for preparing insoluble electrodes according to the present invention.

(1) Formation of pinholes on the surface of the electrode is reduced and a platinum group metal, or its compound-rich diffusion layer, is extremely thinly formed in the vicinity of the surface layer of the electroconductive base metal of the electrode. Accordingly, even if pinholes are present, since the corrosion resistance of the base material is high, rapid propagation of corrosion from the pinholes, which is observed in the conventional techniques, does not occur and the life of the electrode can be remarkably prolonged.

(2) Since high-speed heating and high-speed cooling can be performed, the crystal grains of the plated metal and electroconductive base metal are made finer, and, under certain cooling conditions, they can be rendered amorphous. Also for this reason, the corrosion resistance is improved.

Furthermore, oxidation or nitriding of the electroconductive base metal can be inhibited by high-speed heating and high-speed cooling.

(3) Since the plated metal is sufficiently diffused and alloyed in the very limited vicinity of the surface layer of the electroconductive base metal, the adhesion of the plating layer is improved.

(4) Since only the portion close to the surface layer of the electrode is subjected to the heat treatment, thermal distortion of the electroconductive base metal is prevented, and the dimension of the electrode is not changed by the heat treatment.

(5) When a platinum group metal is plated, hydrogen is absorbed in the electroconductive base metal. However, this absorbed hydrogen can be removed by high-speed heating and the bad influences of hydrogen can be eliminated.

(6) By first applying a platinum group metal and then a platinum group metal oxide as an overlying layer, the corrosion resistance can further be enhanced.

(7) In the case where the heat treatment is carried out by utilizing laser beams, if the material to be irradiated is a metal, the beam absorption ratio is low, less than 10%, so that only a small amount energy is utilized, making the treatment more efficient. According to the present invention, however, since the surface of the electrode is plated with a platinum group metal and the surface is uneven, beams can be absorbed at a high efficiency and, in the case of a carbon dioxide gas laser, more than 70% of the applied energy can be absorbed. Therefore, it can be said that the energy is utilized at the highest efficiency when the plated surface is irradiated with laser beams.

The present invention will now be described in detail with reference to the following Examples.

EXAMPLE 1

The surface of an electroconductive base metal having dimensions of 200×150×2 mm and consisting of titanium was pickled and cleaned, and, according to the conventional plating method, platinum was plated on the surface of the electroconductive base metal at an average thickness of 1 μm to form a platinum-plated electrode. Beams of a carbon dioxide gas laser were applied to the surface of the electrode at an output of 1 KW and a spot diameter of 3 mm at an electrode-moving speed of 20, 40, 60 or 80 m/sec. The irradiation was carried out while argon gas was being jetted.

The durability of the obtained electrodes was examined in an electrolyte containing 100 g/l of $Na_2SO_4$ and 130 g/l of $(NH_4)_2SO_4$ which had a pH value of 1 and was maintained at 50° C. by using a tin plate as the cathode. The electrolysis was carried out at a current density of 200 A/dm$^2$ with an electrode distance of 27 mm. A cycle of 30 minutes application of electricity and 10 minutes interruption (cathode-anode coupling) was repeated (hereinafter referred to as an "intermittent electrolysis test"). The weight loss and the Coulomb quantity conducted through electrode until the voltage increase were determined to obtain the results shown in FIG. 7 and Table 1.

TABLE 1

| Laser Speed (mm/sec) | Corrosion Speed (g/m$^2$ · day) | Voltage Increase (Coulomb × 10$^6$) |
|---|---|---|
| not irradiated | 9 | 70 |
| 20 | 2 | 290 |
| 40 | 2 | 300 |
| 60 | 3 | 289 |
| 80 | 3 | 288 |

Figure 7:
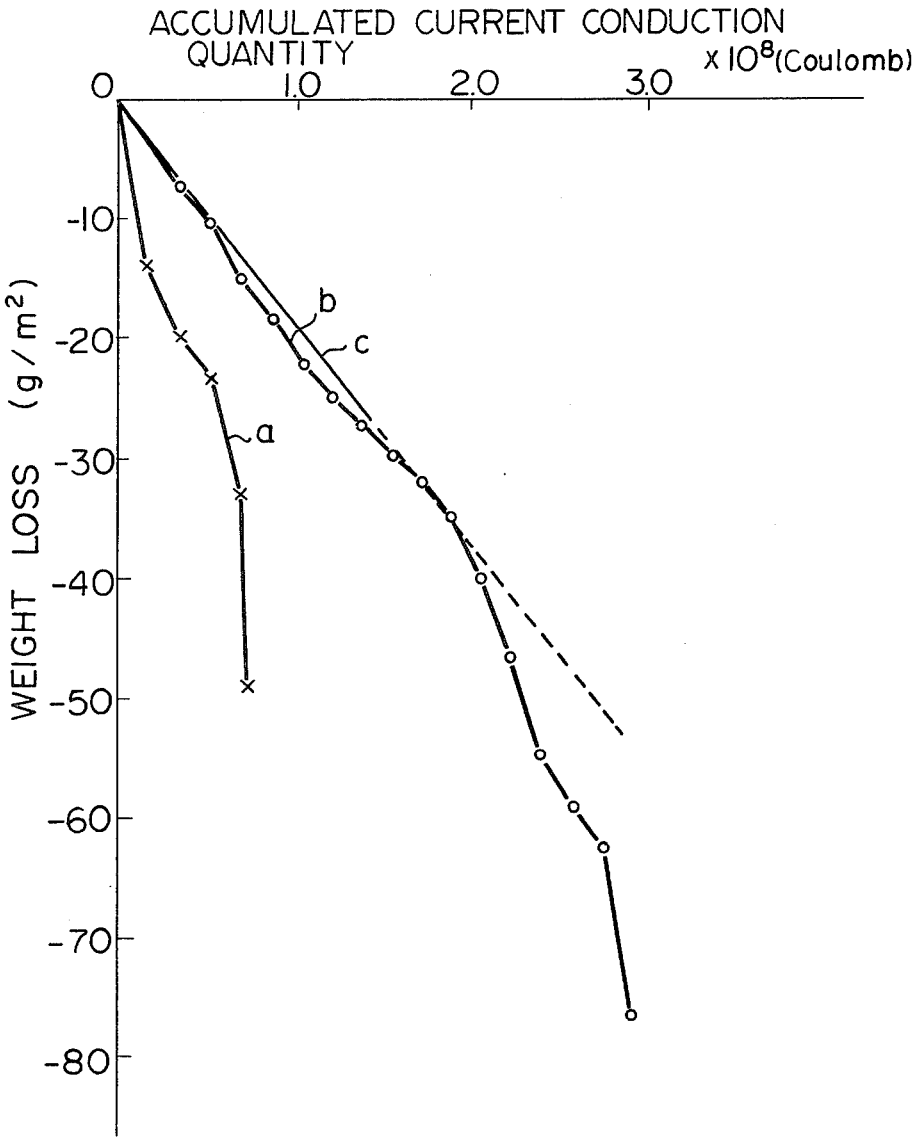
FIG. 7 is a diagram illustrating the relation between the quantity of applied electricity and weight loss.

In FIG. 7, curve a shows the results obtained with respect to a non-irradiated, 1 μm-platinum-plated titanium plate; curve b shows the results obtained when the irradiation speed was 60 mm/sec; and curve c shows the results obtained when a platinum plate was used for comparison.

The electrode obtained in Example 1 was subjected to electrolysis while continuously conducting an electric current at a density of 200 A/cm$^2$ (hereinafter referred to as a "continuous electrolysis test"). In the case of a non-irradiated electrode, the Coulomb quantity was 200, but when the irradiation speeds were 20, 40, 60 and 80 mm/sec, the Coulomb quantities were 3000, 3500, 3000 and 3000, respectively.

EXAMPLE 2

According to the procedures described in Example 1, platinum is electroplated on a cleaned titanium plate at a thickness of 1 μm. Then, the plated titanium plate was coated with an aqueous solution of alcohol containing platinum chloride and lavender oil and heated in a reducing flame of city gas at 400° C. to effect a thermal decomposition plating at a thickness of 1 μm to form a double-plated electrode.

The electrode was irradiated with laser beams at an output of 1 KW and a spot diameter of 3 mm at an irradiation speed of 20 m/sec. According to the method described in Example 1, the Coulomb quantity necessary for the voltage increase was determined. In the case of the non-irradiated electrode, the Coulomb quantity was $140\times10^6$, but in the case of the irradiated electrode, the Coulomb quantity was $500\times10^6$.

EXAMPLE 3

Decomposition plating was performed on a cleaned titanium plate at a thickness of 1 μm in the same manner as described in Example 1. Then, in the same manner as described in Example 2, the resulting electrode was irradiated with laser beams and the life of the electrode was determined. In the case of the non-irradiated electrode, the Coulomb quantity necessary for the voltage elevation was $20\times10^6$, but in the base of the irradiated electrode, the Coulomb quantity was $200\times10^6$.

EXAMPLE 4

An electrode was prepared in the same manner as described in Example 2, except that a second plating layer having a thickness of 1 μm was prepared by using Ir. The life of the irradiated electrode was about 5 times as long as the life of the non-irradiated electrode.

EXAMPLE 5

Two electroconductive base metals, one consisting of tantalum and the other consisting of niobium, were subjected to pickling so as to clean their surfaces, and subsequently platinum was electroplated on the surfaces of each up to an average thickness of 3 μm, thereby producing the platinum-plated electrodes. Beams of a carbon dioxide gas laser were applied to each electrode surface at an output of 10 KW and a spot diameter of 3 mm at an electrode moving speed of 500 mm/second. Observation of the cross section of each electrode proved that the thickness of the diffusion layer formed was about 0.2 μm.

Each electrode was tested under the electrolysis conditions of Example 1 and the corrosion speed calculated from the corrosion loss was about 3 g/m$^2$ day.

EXAMPLE 6

An electroconductive base metal consisting of titanium was subjected to a surface cleaning by means of ion sputtering in an argon gas at $10^{-2}$Torr. Platinum was then applied on the electroconductive base metal by means of an ion plating method. Investigation by a β-ray film thickness tester revealed that the platinum plating layer had a thickness of about 2 μm. The so produced platinum-plating electrode was irradiated with beams of a carbon dioxide gas laser under the following irradiating conditions: the output-2 KW; spot diameter-3 mm; and, the moving speed of electrode-20 mm/second. The Coulomb quantity, until the voltage increase, was measured in accordance with the procedure of Example 1. In the case of the non-irradiated electrode, the Coulomb quantity was $180\times10^6$, while in the case of the irradiated electrode the Coulomb quantity was $800\times10^6$. The plating layer of the non-irradiated electrode peeled in the Scotch tape test, but no peeling occurred in the case of the irradiated electrode.

From the results obtained in the foregoing examples, it will readily be understood that the electrode life can be remarkably prolonged according to the process of the present invention, which is characterized in that the plated surface is heat-treated by irradiation with laser beams after forming, on an electroconductive base metal, at least one metal layer consisting of the platinum group metals. Therefore, the present invention is very valuable from the industrial viewpoint.

We claim:

1. A long-life insoluble electrode for use in sulfuric acid plating baths, comprising:

an electroconductive, corrosion resisting base metal;

at least on metal layer applied on the surface of said electroconductive, corrosion resisting base metal, said at least one metal layer consisting of at least one metal of the platinum group; and, an alloy layer having a thickness of not more than 1 μm between said electroconductive, corrosion resisting base metal and said at least one metal layer, said alloy layer resulting from laser beam irradiation which causes diffusion of said platinum group metals from said at least one metal layer into said electroconductive, corrosion resisting base metal.

2. A long-life insoluble electrode according to claim 1, wherein said electroconductive, corrosion resisting base metal consists of titanium.

3. A long-life insoluble electrode according to claim 1, wherein said electroconductive, corrosion resisting base metal consists of tantalum.

4. A long-life insoluble electrode according to claim 1, wherein said electroconductive, corrosion resisting base metal consists of niobium.

5. A long-life insoluble electrode according to claim 1, wherein said at least one metal layer applied on the surface of said electroconductive, corrosion resisting base metal consists of one of platinum, iridium, ruthenium, rhodium or palladium.

6. A long-life insoluble electrode for use in sulfuric acid plating baths, comprising:

an electroconductive, corrosion resisting base metal;

at least one metal layer applied on the surface of said electroconductive, corrosion resisting base metal, said at least one metal layer consisting of at least one metal of the platinum group; and, an upper layer consisting of an oxide or oxides of the platinum group metals and formed on said at least one metal layer; and further comprising an alloy layer having a thickness of not more than 1 μm formed on said electroconductive, corrosion resisting base metal and adjacent said at least one metal layer, said alloy layer resulting from laser beam irradiation which diffuses said platinum group metals from said at least one metal layer into said electroconductive, corrosion resisting base metal.

7. A process for preparing long-life insoluble electrode according to claim 1 which comprises the steps of:

(1) coating the surface of an electroconductive, corrosion resisting base metal with at least one metal layer consisting of at least one metal of the platinum group; and (2) applying laser beams to the thus-coated surface.

8. A process according to claim 7, wherein the energy density of the applied laser beams is not less that 1 $KW/cm^2$ and the laser energy is not more than 10 kjoule/$cm^2$.

9. A process according to claim 7, wherein the energy density of the applied laser beams is not less than 10 $KW/cm^2$ and the irradiation at the laser energy from 0.1 to 5 kjoule/$cm^2$ is conducted while either of the laser beams or the electrode being irradiated are displaced relative to the other at a rate of from 1 to 100 cm/second.

10. A process according to claim 7 in which the laser used for applying laser beams is a $CO_2$ laser having a wavelength of 10.6 μm or a YAG laser having a wavelength of 1.06 μm.

11. A process according to claim 7 wherein said coated surface is maintained in an essentially non-oxidizing atmosphere while being subjected to the laser beam irradiation.

12. A process according to claim 7 wherein said coated surface is maintained in an oxidizing atmosphere while being subjected to the laser beam irradiation.

13. A process according to claim 7 wherein platinum is first electroplated on the base metal up to a thickness of from 1 to 6 μm and thereafter laser beams are applied.

14. A process according to claim 7 wherein the base metal is titanium, and after the coating of platinum, iridium, ruthenium, rhodium or palladium is applied laser beam treatment is conducted at least twice.

15. A process according to claim 7 wherein the base metal is titanium and platinum is electroplated on the titanium base metal, the further step of coating at least one of platinum, iridium, ruthenium, rhodium or palladium on the platinum plated layer and thereafter applying laser beams at least once.

16. A process according to claim 7 wherein said coating is conducted by means of a vacuum plating method.

17. A process according to claim 14 wherein the coating consisting of platinum, iridium, ruthenium, rhodium or palladium is applied by a vacuum plating method.

18. A process according to claim 7 wherein said coating is conducted by means of a thermal decomposition plating method.

19. A process according to claim 7 wherein said coating of the surface of electroconductive, corrosion resisting base metal is platinum, iridium, ruthenium, rhodium or palladium applied by a thermal decomposition plating method.

20. A process for the preparation of long-life insoluble electrode according to claim 6, which comprises the steps of:

(1) coating the surface of an electroconductive, corrosion resisting base metal with at least one metal layer consisting of at least one metal of the platinum group; and then (2) coating at least one oxide of said platinum group metal member; and thereafter (3) applying laser beams to the thus-coated surface.

* * * * *